United States Patent [19]

Medovar et al.

[11] 4,121,648

[45] Oct. 24, 1978

[54] APPARATUS FOR ELECTROSLAG CASTINGS OF SEMICIRCULAR BLANKS

[76] Inventors: Boris Izrailevich Medovar, ulitsa Anri Barbjusa, 22/26, kv. 109; Valery Alexandrovich Prikhodko, bulvar Davydova, 7, kv. 158; Jury Fedorovich Alferov, bulvar Lepse, 29, kv. 64; Ilya Iosifovich Kumysh, Vozdukhoflotsky prospekt, 42, kv. 51; Alexandr Petrovich Beloglazov, prospekt Voroshilova, 17a, kv. 16, all of Kiev, U.S.S.R.

[21] Appl. No.: 774,733

[22] Filed: Mar. 7, 1977

[51] Int. Cl.[2] ..... B22D 27/02

[52] U.S. Cl. ..... 164/252

[58] Field of Search ..... 164/52, 252, 155

[56] References Cited

U.S. PATENT DOCUMENTS 3,721,286 3/1973 Paton et al. ..... 164/52

4,020,893 5/1977 Paton et al. ..... 164/252

FOREIGN PATENT DOCUMENTS 1,103,350 2/1968 United Kingdom ..... 164/252

*Primary Examiner*—Francis S. Husar

*Assistant Examiner*—Gus T. Hampilos

*Attorney, Agent, or Firm*—Lackenbach, Lilling & Siegel

[57] ABSTRACT

The apparatus has a mould comprising conjugate stationary and movable parts, said movable part being a drum with a horizontal axis of rotation and having a drive for the rotation thereof. A bottom plate is fixedly attached to the drum and serves to strip the blank being cast from the mould through the action of said drum. The apparatus is provided with a carriage for the displacement of a consumable electrode relative to said drum, which is rotatably mounted on the drum shaft. The carriage has a separate drive for its rotation on the shaft and carries a holder with the consumable electrode.

3 Claims, 2 Drawing Figures

APPARATUS FOR ELECTROSLAG CASTINGS OF SEMICIRCULAR BLANKS

The present invention relates to electrometallurgy, and more particularly, to apparatus for the electroslag casting of semicircular blanks.

Known in the prior art is an apparatus for the electroslag casting of semicircular blanks by remelting a consumable electrode having the shape of a half-ring. Such an apparatus has a separable mould, consisting of a stationary part and a movable part which are conjugated therein. The movable part is made in the form of a drum mounted on a horizontal shaft and being capable of rotation therewith. This rotation is effected by means of a drive unit installed on a foundation. Said drum carries a bottom plate fixedly attached thereto which is used for stripping the blank from the mould. The drum also carries a holder for a consumable electrode. The latter is insulated from the drum by means of insulating spacers. The electrode is connected to a power-supply through said holder.

It is essential for casting in this prior art apparatus that the cross-section areas of the consumable electrode and the blank being cast should be equal, since the electrode is fed into the melting chamber of the mould and the blank is stripped therefrom simultaneously using one motion or drive, namely, the rotation of the mould's movable part The disadvantage of the hereinbefore described prior-art apparatus is that the process of casting therein may be upset due to the fact that actually the cross-section area of the electrode cannot be maintained exactly equal to that of the blank being cast. When the former exceeds the latter, the electrode comes into contact with the surface of the blank. When it is smaller, the electrode comes out of the slag bath. In both cases the process of casting becomes disrupted and must be stopped.

The present invention has for its object the provision of an apparatus for the electroslag casting of semicircular blanks which allows displacement of the consumable electrode relative to the mould's movable part in accordance with the difference between the electrode's and blank's cross-section areas whenever such a difference occurs.

Another object of the invention is to provide an apparatus wherein a separate drive for the relative displacement between the consumable electrode and the mould's movable part is simple to manufacture and operate, being adapted for a wide-range speed regulation for said relative displacement.

Still another object of the invention is to provide an apparatus wherein the consumable electrode is insulated from the mould's movable part (the drum) by means of spacers made of a material whose composition is identical with that of the slag in the mould's melting chamber, which obviates the need for a flux batching device in the apparatus.

These and other objects of the present invention are attained in an apparatus for the electroslag casting of semicircular blanks by remelting a consumable electrode shaped as a half-ring and having a cross-section area which is substantially equal to that of a blank being cast. The apparatus comprises separable mould, said mould having a melting chamber and a blank-forming chamber and having a movable part and a stationary part which are in a conjunct relation with each other.

The movable part is a power-driven drum with a horizontal axis of rotation and it carries an electrode holder with said consumable electrode and a bottom plate for stripping the blank from said blank-forming chamber of the mould. Further, the apparatus has a carriage for the displacement of the electrode relative to said drum, and the carriage is rotatably mounted on one shaft with said drum, carrying an electrode holder fixedly attached thereto, and is provided with a separate drive for its rotation on the shaft of said drum.

The apparatus for the electroslag casting of semicircular blanks according to the present invention makes it possible to displace the consumable electrode relative to the movable part of the mould during casting when there is a difference in the electrode and blank cross-section areas, thereby preventing the disruption or scramming of the electroslag casting process.

It is preferable that the separate drive of the carriage for the displacement of the consumable electrode relative to the drum be made in the form of a hydraulic cylinder pivotally connected to said drum, with the piston rod thereof pivotally connected to said carriage, which allows said separate drive to be made compact, simple to manufacture, reliable in operation and capable of providing a wide-range speed regulation for the displacement of the consumable electrode relative to the mould's movable part.

It is also desirable that the consumable electrode be insulated from said drum by means of spacers made of a solid slag whose composition is identical with that used for the slag bath in the mould's melting chamber. Such special spaces obivate the need for a flux batching device.

The present invention will now be described by way of example with reference to the accompanying drawings wherein.

Figure 1:
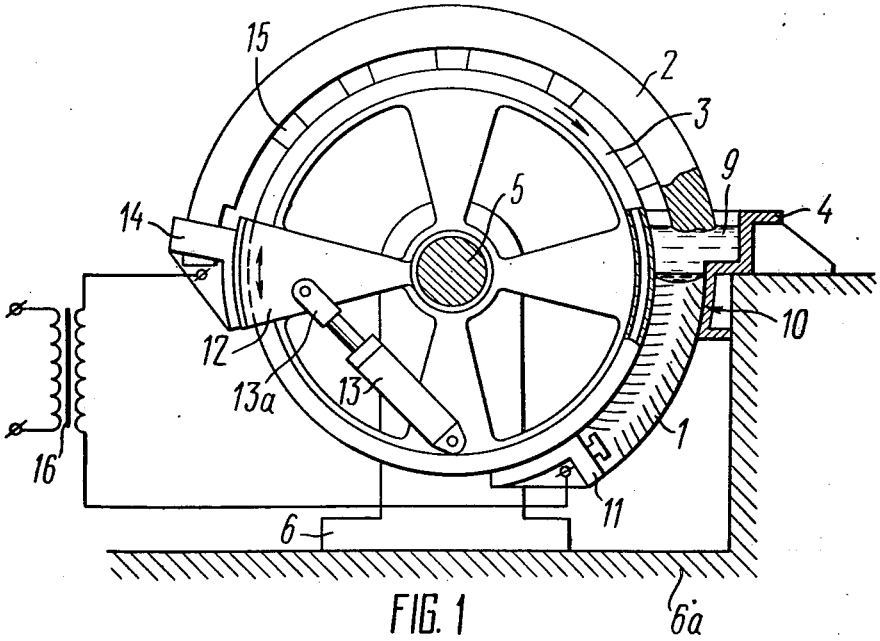
FIG. 1 is a side elevation view of an apparatus for the electroslag casting of semicircular blanks according to this invention, with the melting zone thereof being partially shown in section.
Figure 2:
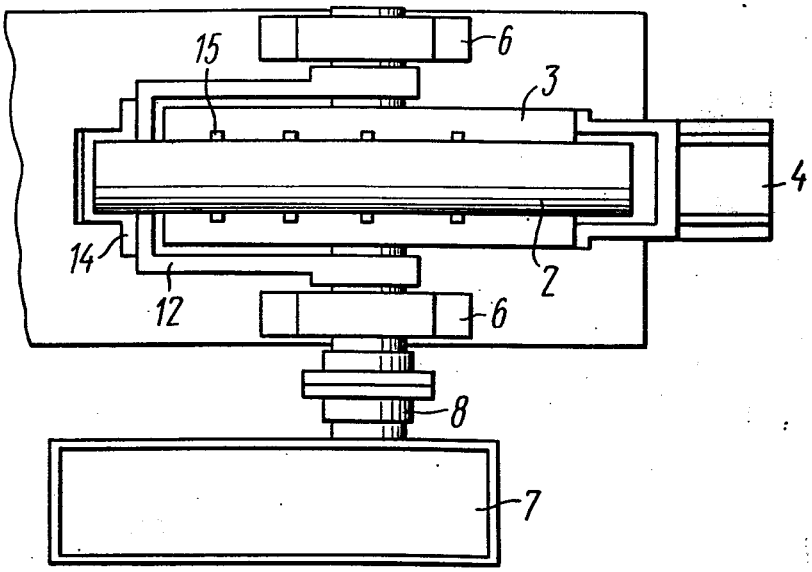
FIG. 2 is a plan view of the apparatus shown in FIG. 1.

In the apparatus for the electroslag casting of a circular blank 1, shown in FIGS. 1 and 2, use is made of a consumable electrode 2 which has the shape of a half-ring. Such electrodes are usually metal castings.

The apparatus has a water-cooled mould made up of a movable part 3 and a stationary part 4.

The movable part 3 is a drum carrying the consumable electrode 2. The drum has a central hole used to mount it on a shaft 5 and can be rotated along with this shaft.

The shaft 5 of the drum 3 is mounted in its bearing blocks 6 mounted stationary on a foundation 6*a*. The movable part or drum 3 is rotated by means of a drive 7 installed on its foundation (not shown). The drive 7 is connected with the shaft 5 by means of a coupling 8.

The stationary part 4 of the mould is open at the side of the drum 3 and is conjugated therewith without any tangible clearance. These two parts make up a closed cavity subdivided into a melting chamber 9 and a chamber 10 wherein said semicircular blank 1 is formed.

The blank-forming chamber 10 is closed at the bottom by a bottom plate 11 which is fixed on the drum 3. The bottom plate 11 is used to strip the blank from the chamber 10 of the mould.

In addition to said drum 3, said shaft 5 accommodates a carriage 12 rotatably mounted thereon for the displacement of the consumable electrode 2 relative to the drum 3. The carriage assumes the shape of a sector which partially envelopes the drum but has no contact therewith.

The carriage 12 is rotatable on the shaft 5 by means of a hydraulic cylinder 13, which is pivotally connected to the drum and whose piston rod 13*a* is likewise pivotally connected to the carriage.

An electrode holder 14 with the consumable electrode 2 fixed therein is rigidly mounted on the carriage. The electrode 2 rests on the drum 3 separated from the surface thereof by means of insulating spacers 15 in the form of the elongate blocks of solid slag. The spacers 15 and the slag in the melting chamber are made of the same material.

The apparatus is connected for power supply to a transformer 16, whose phases are connected to the electrode holder 14 and the bottom plate 11.

The bottom plate 11 is brought into the blank-forming chamber 10 of the mould before the process of casting begins.

The consumable electrode 2 is placed on the drum 3 through the insulating spacers 15 and is fixed in its holder 14. The total volume of the spacers 15 equals that spent on a solidified lining of slag developing in the mould during casting.

The required clearance between the bottom plate and the end face of the consumable electrode is set up with the aid of the separate drive 7.

Molten slag is poured into the mould.

The drum 3 is then rotated (in the direction indicated by the arrow in FIG. 1) for feeding the consumable electrode into the melting chamber 9 and casting the blank 1. To effect the process, one phase of the transformer 16 is connected to the electrode holder 14 and the other to the bottom plate 11, as noted hereinabove.

As the electrode melts away, the insulating spacers 15 get into the melting chamber 9, melt therein and so maintain the slag-bath level within the specified limits. A part of the slag in the melting chamber forms a solidified slag lining for the blank.

In the course of casting, the cross-section areas of the consumable electrode and the blank being cast may differ. If the cross-section area of said consumable electrode happens to exceed that of the blank, the carriage 12 is turned on the shaft 5 in the direction opposite that of rotation of the drum 3, and this decreases the rate of the electrode feed. When the cross-section area of the electrode happens to be less than that of the blank, the carriage is turned in the direction of rotation of the drum, thus increasing the rate of the electrode feed into the mould's melting chamber 9.

With the cross-section areas of the electrode and the blank being equal, the carriage with the consumable electrode rotates together with the drum without any relative displacement therebetween.

When the casting process is completed, the stub of the electrode 2 is removed from the holder 14, and the blank is removed from the apparatus. All the units of the apparatus are brought back to initial position, and the apparatus is then ready for a new working cycle.

We claim:

1. In an improved apparatus for the electroslag casting of semicircular blanks by remelting a consumable electrode shaped as a half-ring and having a cross-section area substantially equal to that of a blank being cast, comprising a separable mould, said mould having a melting chamber and a blank-forming chamber and consisting of a stationary part and a movable part, said parts being in conjunct relation with each other, said movable part being a power-driven drum indirectly carrying an electrode holder with a horizontal axis of rotation; a drive for rotation of said drum; a consumable electrode placed on said drum, said electrode being insulated from the surface of said drum; said holder being used for fixing said consumable electrode and for conducting electric current from a power supply thereto, a bottom plate mounted on said drum for stripping said blank from the blank-forming chamber of said mould; the improvement comprising carriage means adapted for the displacement of said consumable electrode relative to said drum; said carriage means being rotatably mounted about said axis of rotation of said drum; and a separate drive operatively associated with said carriage means for rotating said carriage means positively or negatively relative to said movable part of said mould in accordance with the difference between the electrode's and blank's cross-sectional areas whenever such a difference occurs during operation of said apparatus, whereby the disruption of a casting process is precluded.

2. An apparatus as claimed in claim 1, wherein said separate drive of said carriage means for the displacement of the consumable electrode relative to the drum comprises a hydraulic cylinder pivotally connected to said drum, and the piston rod of said hydraulic cylinder being pivotally connected to said carriage means.

3. An apparatus as claimed in claim 1, wherein said consumable electrode is insulated from said drum by means of spacers made of a solid slag whose composition is identical with that of the slag in the melting chamber of said mould.

* * * * *